US005849444A

United States Patent [19]

Kinoshita et al.

[11] Patent Number: 5,849,444

[45] Date of Patent: Dec. 15, 1998

[54] ELECTROPHOTOGRAPHIC PHOTORECEPTOR WITH ALIPHATIC AMINE CONTAINING ELECTRON TRANSPORTING LAYER

[75] Inventors: Akira Kinoshita; Hirofumi Hayata; Toyoko Shibata; Tomoko Suzuki, all of Hino, Japan

[73] Assignee: Konica Corporation, Tokyo, Japan

[21] Appl. No.: 895,211

[22] Filed: Jul. 16, 1997

[30] Foreign Application Priority Data

Jul. 22, 1996 [JP] Japan ..... 8-192131

[51] Int. Cl.[6] ..... G03G 5/04

[52] U.S. Cl. ..... 430/58

[58] Field of Search ..... 430/58, 59

[56] References Cited

U.S. PATENT DOCUMENTS

| | | | |
|---|---|---|---|
| 4,855,203 | 8/1989 | Badesha et al. | 430/59 |
| 5,164,276 | 11/1992 | Robinson et al. | 430/59 |
| 5,550,293 | 8/1996 | Shimada et al. | 430/59 |

*Primary Examiner*—John Goodrow
*Attorney, Agent, or Firm*—Frishauf, Holtz, Goodman, Langer & Chick, P.C.

[57] ABSTRACT

An electrophotographic photoreceptor is disclosed, comprising a conductive support and having thereon a photoreceptor layer comprising an electron-transporting charge transport layer containing an organic electron-transporting material in a binder, the electron transporting charge transport layer further containing an aliphatic amine compound having an oxidation potential of 0.5 to 0.9 V versus a silver/silver chloride electrode, in an amount of 0.01 to 20 parts by weight based on 100 parts of the electron-transporting material.

6 Claims, 1 Drawing Sheet

FIG. 1 - a
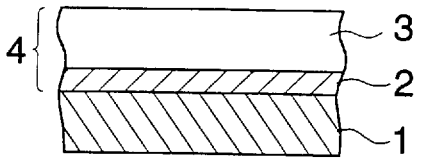
FIG. 1 - b
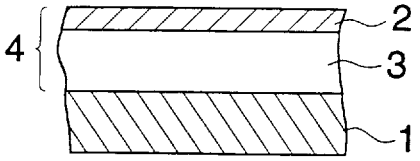
FIG. 1 - c
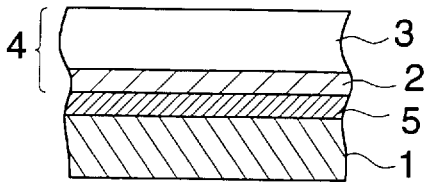
FIG. 1 - d
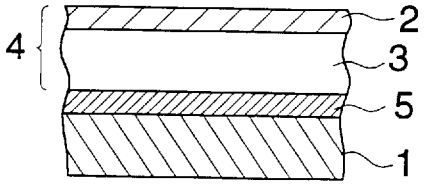
FIG. 1 - e
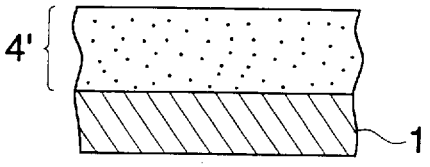
FIG. 1 - f
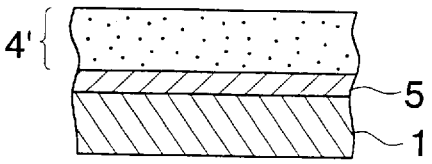

ELECTROPHOTOGRAPHIC PHOTORECEPTOR WITH ALIPHATIC AMINE CONTAINING ELECTRON TRANSPORTING LAYER

FIELD OF THE INVENTION

The present invention relates to an electrophotographic photoreceptor for forming a electrostatic latent image. More specifically, the invention relates to an electrophotographic photoreceptor having a charge transport layer containing an electron transporting compound.

BACKGROUND OF THE INVENTION

Recently, organic photoreceptors with superior characteristics such as high photosensitivity, little influenced by temperature and humidity and quick response to semiconductor lasers, are broadly employed in copying machines, printers and facsimiles according to electrophotographic techniques.

In the electrophotographic photoreceptors, there is markedly broadened field for selecting materials by employing a function-separated type constitution in which the function of generating a charge and the function of transporting the charge are separately performed by different materials. In particular, it enables designing of a broad range of groups of chemical structure in organic compounds, resulting in superior materials having been developed in charge generation materials and charge transport materials.

As a charge generation material, there have been proposed a variety of organic dyes and organic pigments. Examples thereof include polycyclic quinone compounds such as dibromanthanthrone, pyrylium compounds, coprecipitated complexes of a pyrylium and polycarbonate, squarium, phthalocyanines and azo compounds.

Examples of the charge transport materials include compounds containing a nitrogen-containing heterocyclic nucleus such as oxazole, thiazole, thiadiazole or imidazole, or its condensed nucleus; polyarylalkane compounds; pyrazoline compounds; hydrazone compounds; triarylamine compounds; styryl compounds; styryltriphenylamine compounds; β-phenylstyryltriphenylamine compounds, butadiene compounds, hexatriene compounds and carbazole compounds. These are all "hole-transporting" materials.

In preparation of the photoreceptor by the combination of a charge generation material and a charge transport material, a layer structure comprising an electrode, and providing thereon, a charge generation layer containing the charge generation material and further thereon, a charge transport layer containing the charge transport material, leads to a photoreceptor with superior durability.

The above-described charge transport materials are hole-transporting ones, so that in such an electrophotographic photoreceptor, the surface of the photoreceptor is negatively charged to be taken into operation. For charging, there have been generally employed corona discharge systems whereby high speed operation is achieved and stable charging characteristics are obtained. With speed-up of the entire electrophotographic process, however, an increase of the amount of ozone produced per unit time has recently become a concern. In order to solve this problem, there is desired a highly durable photoreceptor in response to positively corona discharging process with reduced ozone emission.

From this viewpoint, there was developed an organic photoreceptor with a layer structure having an electron-transporting charge transport layer as an upper layer. As electron transporting materials proposed are 2.4,7-trinitrofluorene and compounds described in JP-A 1-206349, 2-214866 and 5-279582 (herein, the term, "JP-A" means unexamined and published Japanese Patent Application) and U.S. Pat. No. 5,468,583. However, even when these electron transporting materials are employed, conventional charge transport layers have serious defects in characteristics of charge injection from the charge generation material, resulting in marked residual potential in photo-response action as an electrophotographic photoreceptor, so that sufficient potential contrast necessary for image-forming can not be obtained.

SUMMARY OF THE INVENTION

It is an object of the present invention to provide a electrophotographic photoreceptor having an electron-transporting charge transport layer in which residual potential is lowered and sufficient image contrast is achieved.

To accomplish the object of the invention by enhancing charge injection to the electron-transporting charge transport layer, our inventors found that it is effective to incorporate a specific amine compound into a photoreceptor layer. Thus, the object of the invention was accomplished by the following:

(1) An electrophotographic photoreceptor comprising a conductive support and, provided thereon, a photoreceptor layer having an electron-transporting charge transport layer containing an electron-transporting material in a binder, said photoreceptor layer containing an aliphatic amine compound having an oxidation potential (Eox) of 0.5 to 0.9 V versus a silver/silver chloride reference electrode, in an amount of 0.01 to 20 parts by weight based on 100 parts by weight of the electron-transporting material;

(2) preferably, the electrophotographic photoreceptor described in above (1), wherein said photoreceptor layer has a layer structure comprising a charge generation layer and the charge transport layer;

(3) preferably, the electrophotographic photoreceptor described in above (1) and (2), wherein said aliphatic amine compound is represented by the following formula (1):

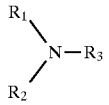

Formula (1)

wherein $R_1$, $R_2$ and $R_3$ each represent a hydrogen atom, substituted or unsubstituted alkyl group, or substituted or unsubstituted alkenyl group, and $R_1$ and $R_2$ may combine with each other to form a ring, provided that $R_1$, $R_2$ and $R_3$ are not hydrogen atoms at the same time.

BRIEF DESCRIPTION OF THE DRAWING

FIG. 1-*a* through 1-*f* illustrate schematic cross-sections with respect to layer configuration of the photoreceptor according to the invention.

DETAILED DESCRIPTION OF THE INVENTION

In formula (1), the alkyl group or alkenyl group represented by $R_1$, $R_2$ and $R_3$ may be substituted. Preferred examples of substituents include an alkyl group with 1 to 20 carbon atoms, acyl group, alkoxycarbonyl group, halogen atom, cyano group, nitro group, hydroxy group, acyloxy group, alkoxy group, amido group, sulfonamido group, aryl group and heterocyclic group.

The oxidation potential of the amine compound can be determined through cyclic voltammetry. Thus, the amine compound is dissolved in an appropriate solvent (e.g., acetonitrile) containing a supporting electrolyte (e.g., tetraethylammonium perchlorate) and its cyclic voltammogram is measured at room temperature using a silver/silver chloride electrode, as a reference electrode. In this case, a potential at which an oxidation reaction occurs, is referred to as an oxidation potential, whether the reaction is reversible or irreversible. The potential is represented as a value versus a silver/silver chloride electrode.

Since sufficient effects cannot be obtained through an aromatic amine compound, the aliphatic amine compound is employed in the invention. Specifically, a hindered amine compound having a branched carbon at the α-position is preferred because it is superior in physical properties of the photoreceptor layer.

In conventional electrophotographic photoreceptors employing a hole transporting material, there is known a technique in which a hindered amine compound is used as an antioxidant to prevent deterioration of the hole transporting material and enhancing its durability. However, there has been known nothing with respect the fact that, among the hindered amine compounds and other aliphatic amine compounds, one having a specific oxidation potential has an effect of enhancing charge injection only on the electron-transporting charge transport layer using an electron transporting material.

According to the invention, the oxidation potential of the aliphatic amine compound is critically important. Thus, when the oxidation potential exceeds 0.9 V, effects of the invention cannot be achieved, and reversely, when the oxidation potential is less than 0.5 V, a residual potential increases and inventive effects also cannot be obtained.

When the amine compound according to the invention is contained in an amount of less than 0.01 parts by weight, effects of the invention are insufficient. Further, when the content thereof is more than 20.0 parts by weight, charging is markedly lowered, or the amine compound is partially precipitated, resulting in an increase of the residual potential.

Exemplary examples of the amine compound according to the invention are shown below, along with their oxidation potentials (Z-1 through Z-15). In addition thereto, there are also shown comparative amine compounds which do not fall within the scope of the invention as claimed, having a chemical structure similar to that of the amine compounds according to the invention (R-1 through R-9).

| | Inventive amine compound | Eox(V) |
|---|---|---|
| Z-1 | $C_{10}H_{21}NH_2$ | 0.57 |
| Z-2 | $(C_8H_{17})_2NH$ | 0.57 |
| Z-3 | $(C_8H_{17})_3N$ | 0.57 |
| Z-4 | $C_4H_9OCH_2CH_2H_2NH_2$ | 0.56 |
| Z-5 | 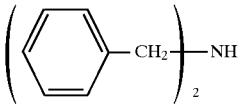 | 0.58 |
| Z-6 | 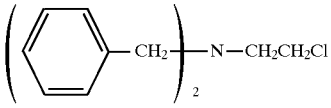 | 0.58 |
| Z-7 | 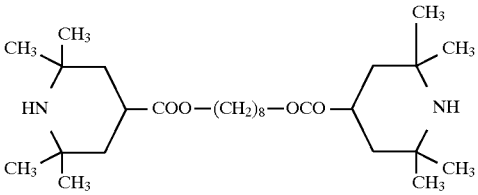 | 0.58 |
| Z-8 | 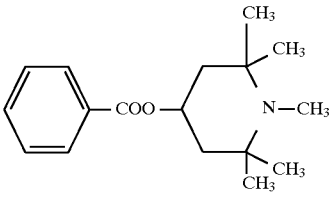 | 0.66 |
| Z-9 | 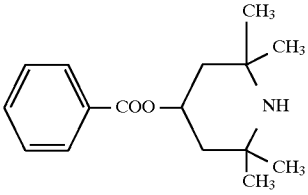 | 0.58 |

-continued
| | | |
|---|---|---|
| Z-10 | 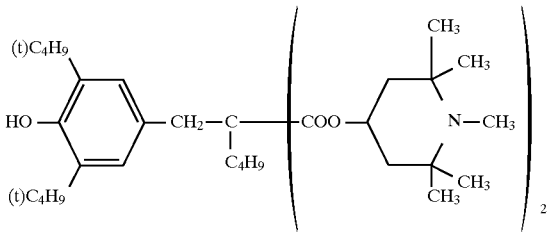 | 0.67 |
| Z-11 | 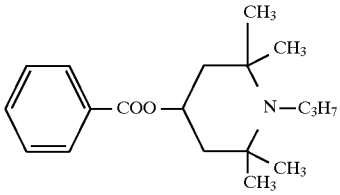 | 0.83 |
| Z-12 | 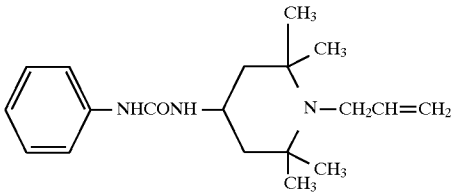 | 0.78 |
| Z-13 | 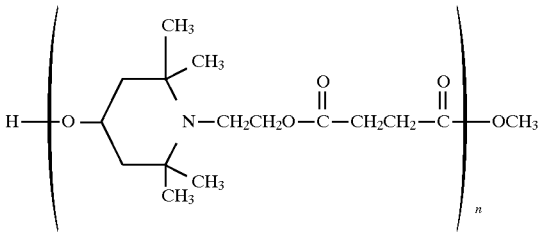 | 0.86 |
| Z-14 | 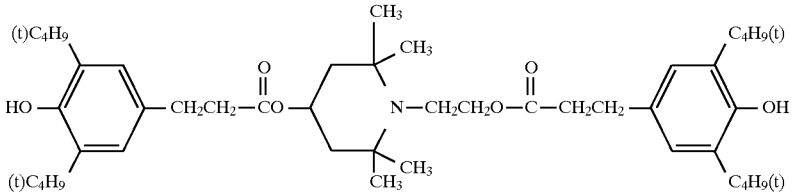 | 0.88 |
| Z-15 | 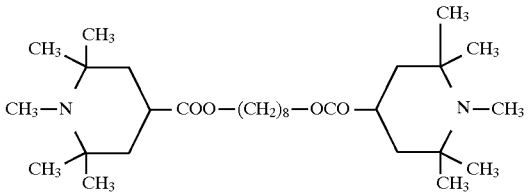 | 0.67 |
| Comparative amine compound | | Eox(V) |
|---|---|---|
| R-1 | 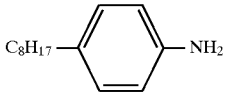 | 0.63 |
| R-2 | 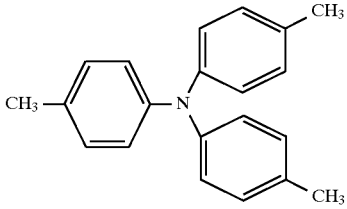 | 0.49 |

-continued

R-3 0.15

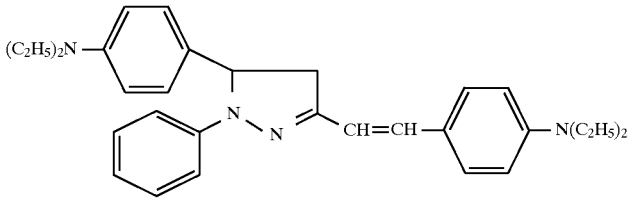

R-4 0.96

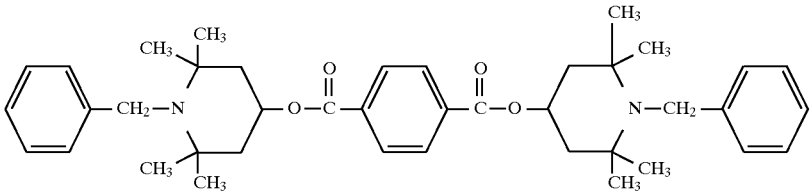

R-5 1.57

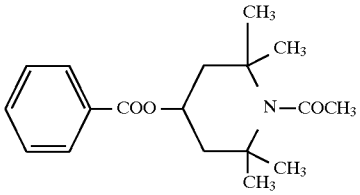

R-6 1.62

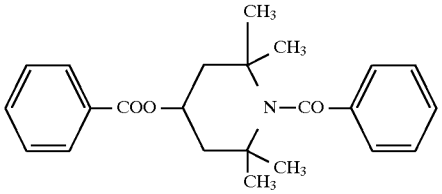

R-7 1.58

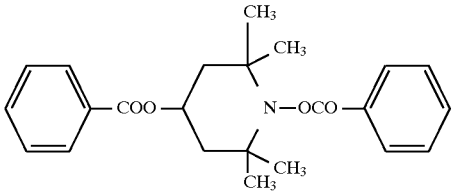

R-8 0.98

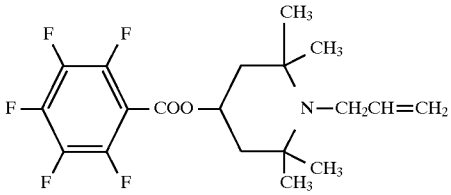

R-9 0.95

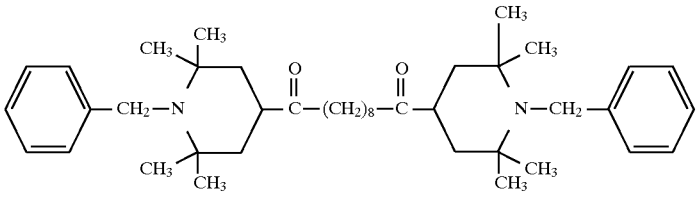

In the invention, the electron-transporting charge transport layer refers to one having electron-transporting capability. The electron-transporting charge transport layer may have hole-transporting capability. However, the electron-transporting charge transport layer according to the invention has the electron-transporting capability superior to the hole-transporting capability. The hole-transporting and electron-transporting capabilities can be determined based on comparison of photosensitivity at the hole transport-controlled action mode and that at the electron transport-controlled action mode of an electrophotographic photoreceptor prepared by combination of a charge generation material. In a photoreceptor comprising a conductive support having thereon a charge generation layer and further a charge transport layer in this order, for example, the expression, "electron transport controlled" means that photosensitivity at the positive charging mode being higher than that at the negative-charging mode. In this case, the photosensitivity (e.g., expressed in half-decay exposure) at the positive-charging mode represents electron-transporting capability and photosensitivity at the negative-charging mode represents hole-transporting capability.

The electron-transporting material employed in the electron-transporting charge transport layer is optional, and those represented by the following formula (A) through (D) are preferably employed.

Formula (A)

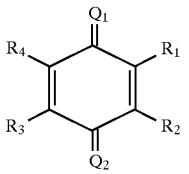

Formula (B)

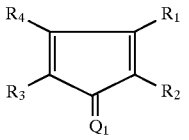

Formula (C)

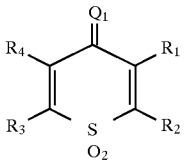

Formula (D)

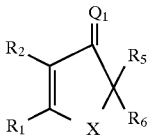

wherein X represents $>SO_2$ or $>C{=}Q_2$; $Q_1$ and $Q_2$ each represent $=\mathbf{0}$, $=S$, $=N{-}R_7$, or $=C(Z_1)(Z_2)$; $R_1$ through $R_9$ each represent a hydrogen atom, halogen atom, cyano group, substituted vinyl group, substituted or unsubstituted alkyl group, substituted or unsubstituted aryl group, or substituted or unsubstituted heterocyclic group. $R_1$ and $R_2$, or $R_3$ and $R_4$ may combine with each other to form an aliphatic or aromatic ring; $R_5$ and $R_6$ may combine with each other to form $=N{-}R_7$ or $=C(R_8)(R_9)$; and $Z_1$ and $Z_2$ each represent an electron-withdrawing group.

Preferred substituents of the substituted vinyl group include a phenyl group, cyano group and alkoxycarbonyl group. The heterocyclic group is preferably a pyridine, thiophene, quinoline or oxazole-ring group. The alkyl group, aryl group and heterocyclic groups each may be substituted. The substituent thereof is preferably an alkyl group, alkoxy group, vinyl group, phenyl group, halogen atom, trifluoromethyl group, cyano group, amino group, alkylamino group, arylamino group, nitro group, alkoxycarbonyl group, acyl group, styryl group, alkylcarbamido group, alkylsulfonamido group or carbamoyl group. The electron-withdrawing group represented by $Z_1$ and $Z_2$ is preferably a cyano group, nitro group, a halogen atom, trifluoromethyl group, alkoxycarbonyl group, acyl group, aryloxycarbonyl group, sulfon group and these groups substituted by a phenyl or naphthyl group.

Examples of the compound represented by formula (A):

| No. | $Q_1$ | $Q_2$ | $R_1$ | $R_2$ | $R_3$ | $R_4$ |
|---|---|---|---|---|---|---|
| A-1 | =O | =O | H | 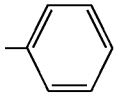 | 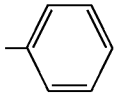 | H |
| A-2 | =O | =O | H | 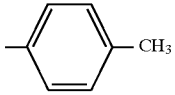 | 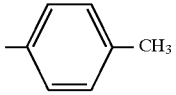 | 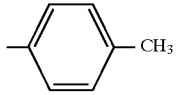 |
| A-3 | =O | =O | 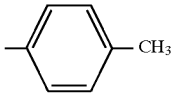 | 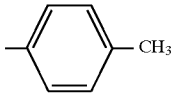 | 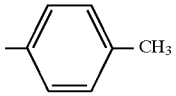 | 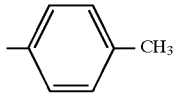 |
| A-4 | =O | =O | Cl | 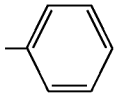 | 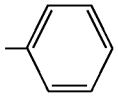 | H |
| A-5 | =N−CN | =O | H | 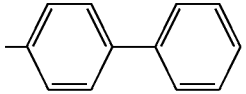 | 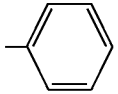 | H |
| A-6 | =N−CN | =O | H | 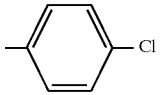 | 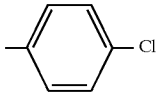 | H |
| A-7 | 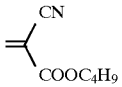 | =O | H | 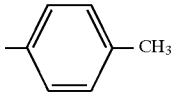 | 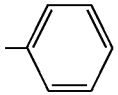 | H |
| A-8 | 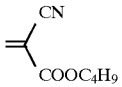 | =O | H | 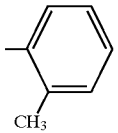 | 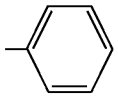 | H |
| A-9 | 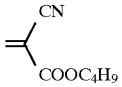 | =O | H | 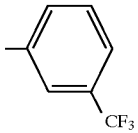 | 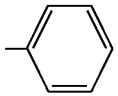 | H |

-continued
| No. | $Q_1$ | $Q_2$ | $R_1$ | $R_2$ | $R_3$ | $R_4$ |
|---|---|---|---|---|---|---|
| A-10 | 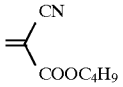 | =O | H | 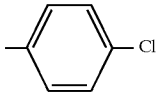 | 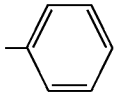 | H |
| A-11 | 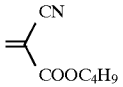 | =O | H | 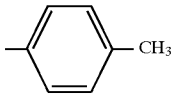 | 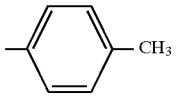 | H |
| A-12 | 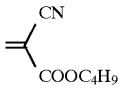 | =O | H | 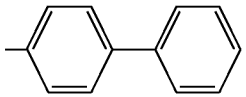 | 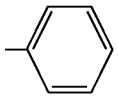 | H |
| A-13 | 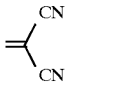 | =O | H | 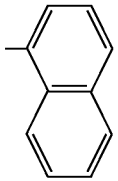 | 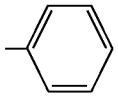 | H |
| A-14 | 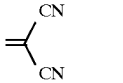 | =O | H | $-C_4H_9$ | $-C_4H_9$ | H |
| A-15 | 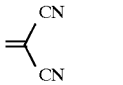 | =O | H | 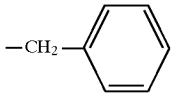 | 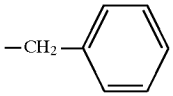 | H |
| A-16 | 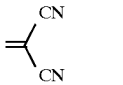 | =O | H | 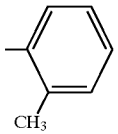 | 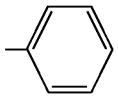 | H |
| A-17 | 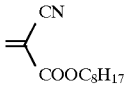 | =O | H | 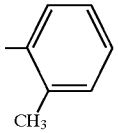 | 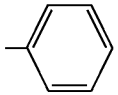 | H |

-continued
| No. | $Q_1$ | $Q_2$ | $R_1$ | $R_2$ | $R_3$ | $R_4$ |
|---|---|---|---|---|---|---|
| A-18 | 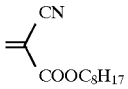 | =O | H | 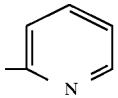 | 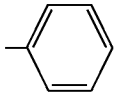 | H |
| A-19 | 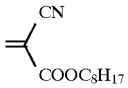 | =O | H | 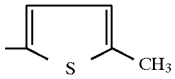 | 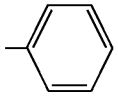 | H |
| A-20 | 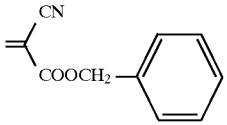 | =O | H | 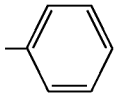 | 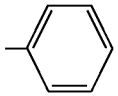 | H |
| A-21 | 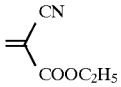 | =O | H | 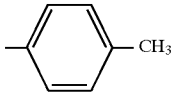 | 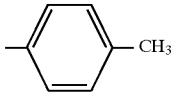 | H |
| A-22 | 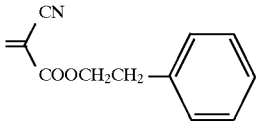 | =O | H | 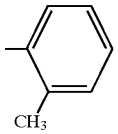 | 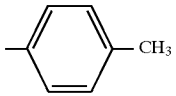 | H |
| A-23 | 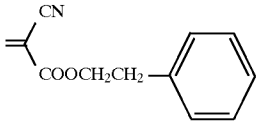 | =O | H | 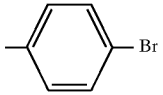 | 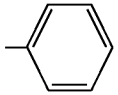 | H |
| A-24 | 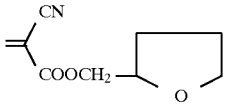 | =O | H | 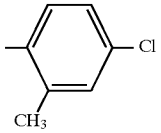 | 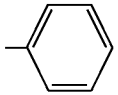 | H |
| A-25 | 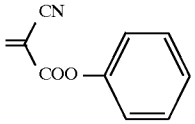 | =O | H | 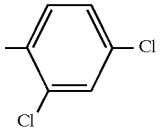 | 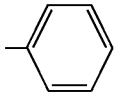 | H |

-continued
| No. | $Q_1$ | $Q_2$ | $R_1$ | $R_2$ | $R_3$ | $R_4$ |
|---|---|---|---|---|---|---|
| A-26 | 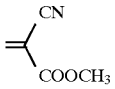 | =O | H | 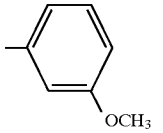 | 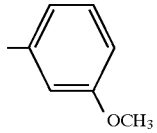 | H |
| A-27 | 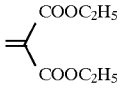 | =O | H | 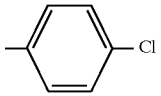 | 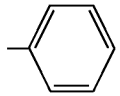 | H |
| A-28 | 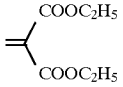 | =O | H | $-CH_3$ | $-CH_3$ | H |
| A-29 | 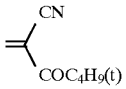 | =O | H | 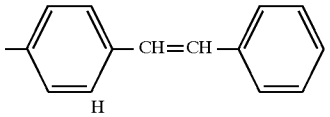 | 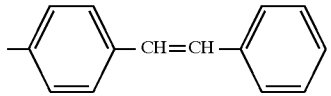 | H |
| A-30 | 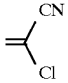 | =O | H | 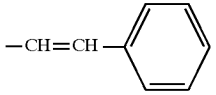 | 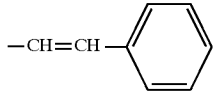 | H |
| A-31 | 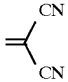 | 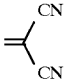 | H | $-CH_3$ | H | $-CH_3$ |
| A-32 | 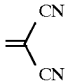 | 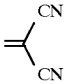 | H | H | H | H |
| A-33 | =O | =O | | 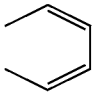 | $-CH_3$ | H |
| A-34 | =O | =O | | 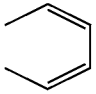 | 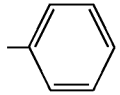 | H |

-continued
| No. | $Q_1$ | $Q_2$ | $R_1$ | $R_2$ | $R_3$ | $R_4$ |
|---|---|---|---|---|---|---|
| A-35 | =O | =O | | 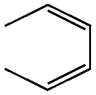 | 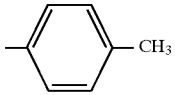 | 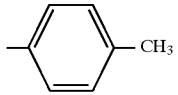 |
| A-36 | =O | =O | | 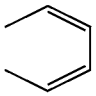 | 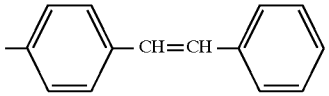 | H |
| A-37 | =O | =O | | 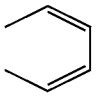 | 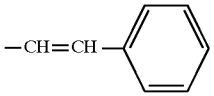 | H |
| A-38 | =N−CN | =O | | 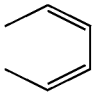 | 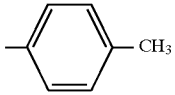 | H |
| A-39 | =N−CN | =O | | 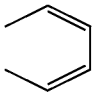 | 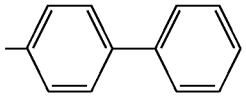 | H |
| A-40 | =N−CN | =O | | 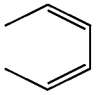 | 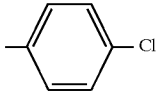 | H |
| A-41 | =N−CN | =N−CN | | 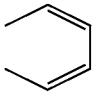 | 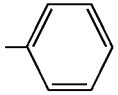 | H |
| A-42 | =N−CN | =N−CN | | 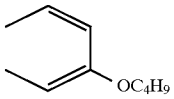 | H | H |
| A-43 | =N−CN | =N−CN | | 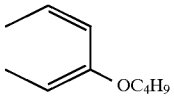 | 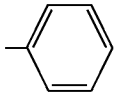 | H |
| A-44 | 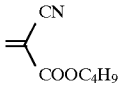 | =O | | 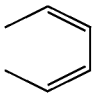 | 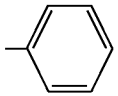 | H |

-continued
| No. | $Q_1$ | $Q_2$ | $R_1$ | $R_2$ | $R_3$ | $R_4$ |
|---|---|---|---|---|---|---|
| A-45 | 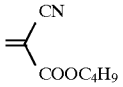 | =O | | 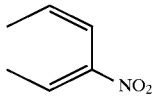 | 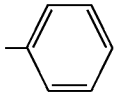 | H |
| A-46 | 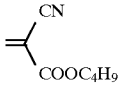 | =O | | 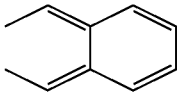 | 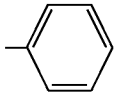 | H |
| A-47 | 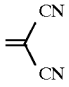 | =O | | 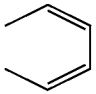 | 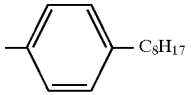 | H |
| A-48 | 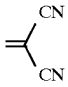 | =O | | 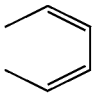 | 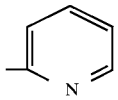 | H |
| A-49 | =O | =O | | 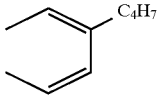 | | 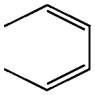 |
| A-50 | =O | =O | | 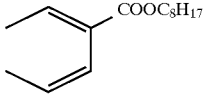 | | 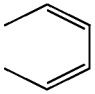 |
| A-51 | =O | =O | | 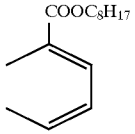 | | 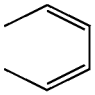 |
| A-52 | =N−CN | =O | | 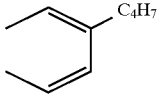 | | 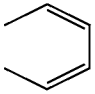 |

-continued

| No. | $Q_1$ | $Q_2$ | $R_1$ | $R_2$ | $R_3$ | $R_4$ |
|---|---|---|---|---|---|---|
| A-53 | =N−CN | =O | | $COOC_8H_{17}$ | | |
| A-54 | =N−CN | =O | | $COOC_5H_{11}$ | | $COOC_5H_{11}$ |
| A-55 | =N−CN | =N−CN | | | | |
| A-56 | $COOC_2H_5$ / $COOC_2H_5$ | =O | | $OC_8H_{17}$ | | |
| A-57 | $COOC_2H_5$ / $COOC_2H_5$ | $COOC_2H_5$ / $COOC_2H_5$ | | | | |
| A-58 | =O | =O | | N | | |
| A-59 | =O | =O | | $NHCOC_9H_{19}$, CN, CN, $NH_2$ | | |

Examples of the compound represented by formula (B):
| No. | $Q_1$ | $R_1$ | $R_2$ | $R_3$ | $R_4$ |
|---|---|---|---|---|---|
| B-1 | =O | 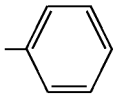 | 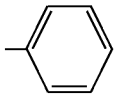 | 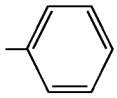 | 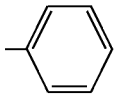 |
| B-2 | =S | 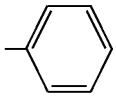 | 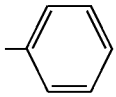 | 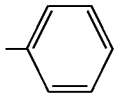 | 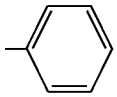 |
| B-3 | =N−CN | 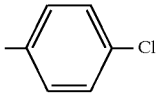 | 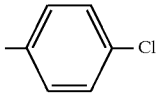 | 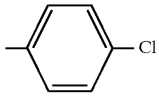 | 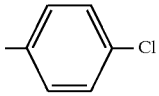 |
| B-4 | =N−CN | 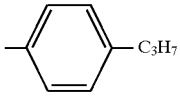 | H | H | 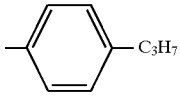 |
| B-5 | =N−CN | 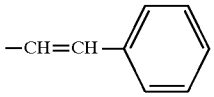 | H | H | 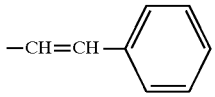 |
| B-6 | 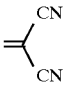 | 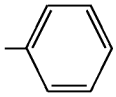 | 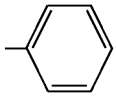 | 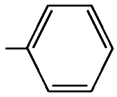 | 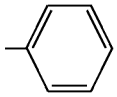 |
| B-7 | 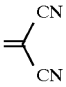 | 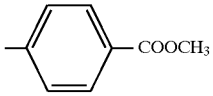 | 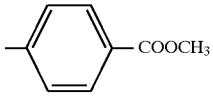 | 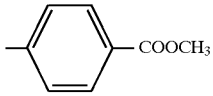 | 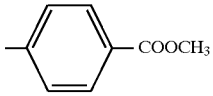 |
| B-8 | 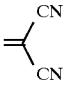 | 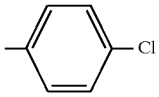 | 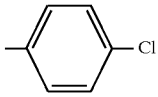 | 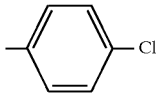 | 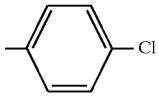 |
| B-9 | 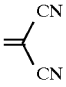 | 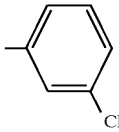 | 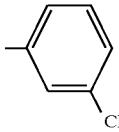 | 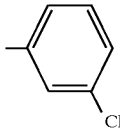 | 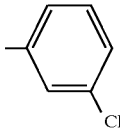 |
| B-10 | =O | | 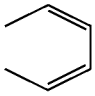 | 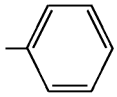 | 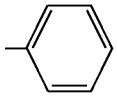 |
| B-11 | =O | | 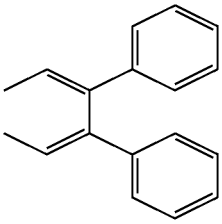 | 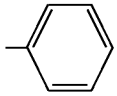 | 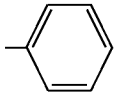 |
| B-12 | 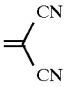 | | 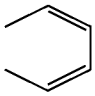 | 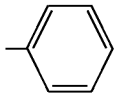 | 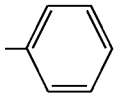 |

-continued
| No. | $Q_1$ | $R_1$ | $R_2$ | $R_3$ | $R_4$ |
|---|---|---|---|---|---|
| B-13 | 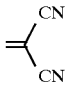 | | 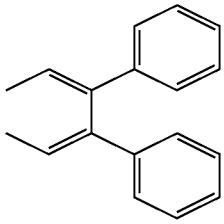 | 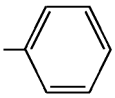 | 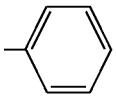 |
| B-14 | 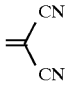 | | 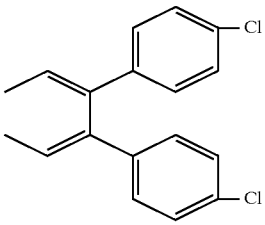 | 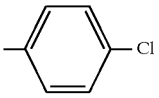 | 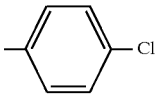 |
| B-15 | 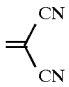 | | 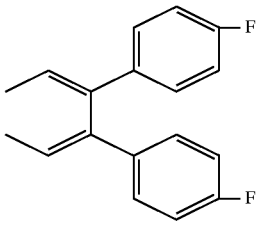 | 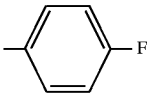 | 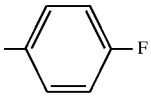 |
| B-16 | =N−CN | | 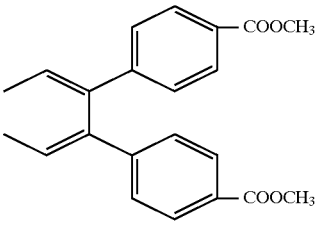 | 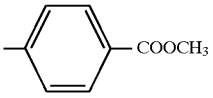 | 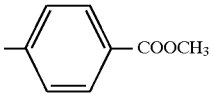 |
| B-17 | =N−CN | | 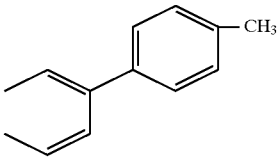 | 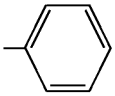 | 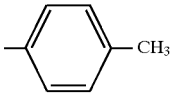 |
| B-18 | =N−CN | | 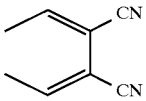 | 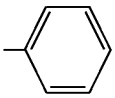 | 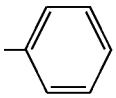 |
| B-19 | 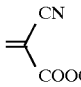 | | 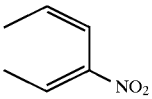 | 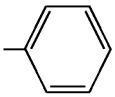 | 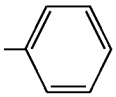 |
| B-20 | 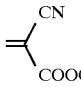 | | 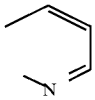 | 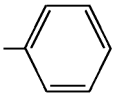 | 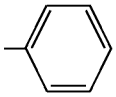 |
| B-21 | =O | | 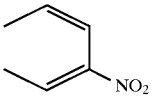 | | 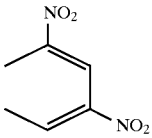 |

-continued
| No. | $Q_1$ | $R_1$ | $R_2$ | $R_3$ | $R_4$ |
|---|---|---|---|---|---|
| B-22 | 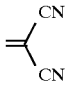 | | 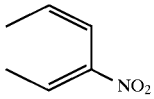 | | 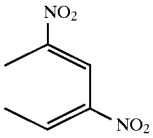 |
| B-23 | 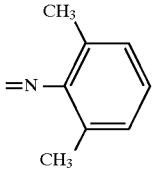 | | 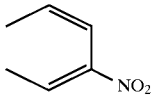 | | 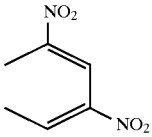 |
| B-24 | 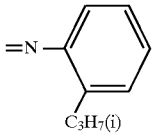 | | 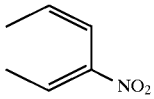 | | 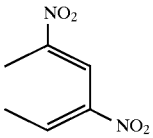 |
| B-25 | 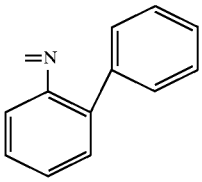 | | 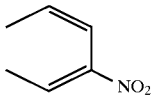 | | 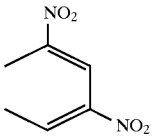 |
| B-26 | =S | | 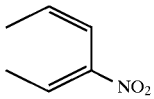 | | 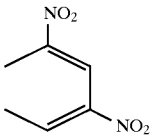 |
| B-27 | =O | | 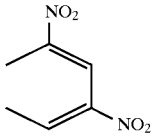 | | 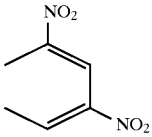 |
| B-28 | 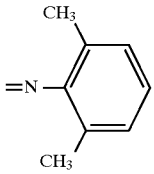 | | 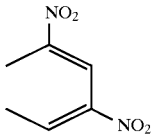 | | 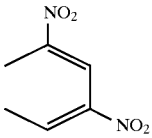 |
| B-29 | 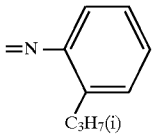 | | 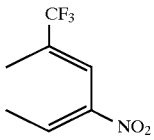 | | 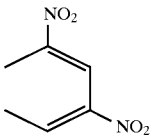 |
| B-30 | 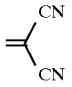 | | 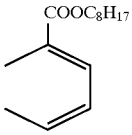 | | 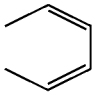 |
| B-31 | 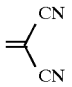 | | 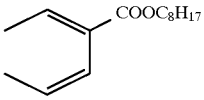 | | 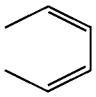 |

-continued
| No. | $Q_1$ | $R_1$ | $R_2$ | $R_3$ | $R_4$ |
|---|---|---|---|---|---|
| B-32 | 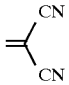 | | 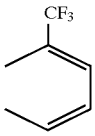 | | 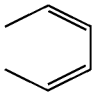 |
Examples of the compound represented by formula (C):
| No | $Q_1$ | $R_1$ | $R_2$ | $R_3$ | $R_4$ |
|---|---|---|---|---|---|
| C-1 | =O | H | 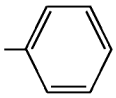 | 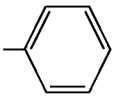 | H |
| C-2 | =O | $-COOC_4H_9$ | 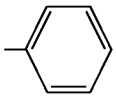 | 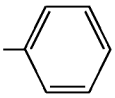 | $-COOC_4H_9$ |
| C-3 | 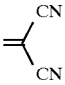 | H | 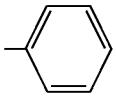 | 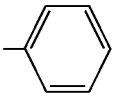 | H |
| C-4 | 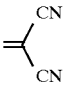 | H | 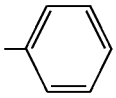 | 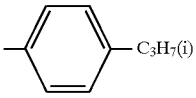 $C_3H_7$(i) | H |
| C-5 | 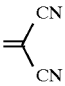 | H | 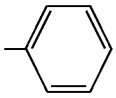 | 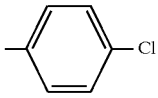 Cl | H |
| C-6 | 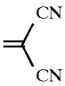 | H | 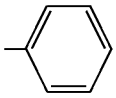 | 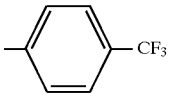 $CF_3$ | H |
| C-7 | 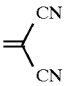 | H | 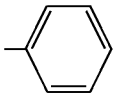 | 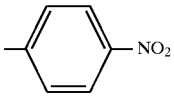 $NO_2$ | H |
| C-8 | =N−CN | H | 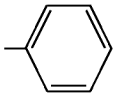 | 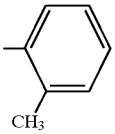 $CH_3$ | H |
| C-9 | =N−CN | H | 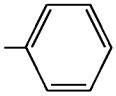 | 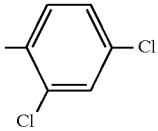 Cl Cl | H |
| C-10 | 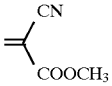 | H | 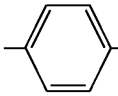 $CH_3$ | 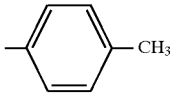 $CH_3$ | H |
| C-11 | 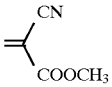 | H | 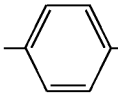 $CH_3$ | 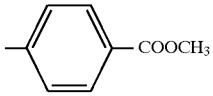 $COOCH_3$ | H |

Examples of the compound represented by formula (D):

| No | $Q_1$ | X | $R_1$ | $R_2$ | $R_5$ | $R_6$ |
|---|---|---|---|---|---|---|
| D-1 | =O | $SO_2$ | | | | $-CH_3$ |
| D-2 | CN, CN | $SO_2$ | | | $-CH_3$ | $-CH_3$ |
| D-3 | CN, CN | C=CN, CN | | | | |
| D-4 | CN, CN | C=CN, CN | Cl | Cl | $-CH_3$ | |
| D-5 | CN, CN | $SO_2$ | | | H | |
| D-6 | CN, CN | $SO_2$ | | | =C(H)– | $C_3H_7$(i) |
| D-7 | CN, CN | $SO_2$ | | | =C(–)(–) | |
| D-8 | =N–CN | $SO_2$ | | | $-CH_3$ | $-CH_3$ |
| D-9 | =N–CN | $SO_2$ | $NO_2$ | | H | $-C_4H_9$ |
| D-10 | CN, CN | C=CN, CN | | | H | |
| D-11 | CN, CN | C=CN, CN | | | H | $-CH_2CH=CH_2$ |
| D-12 | CN, CN | C=CN, CN | | | $-CH_3$ | $-CH_2$– |

-continued

| No | $Q_1$ | X | $R_1$ | $R_2$ | $R_5$ | $R_6$ |
|---|---|---|---|---|---|---|
| D-13 | 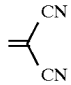 | 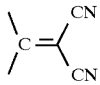 | 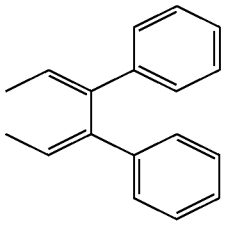 | | 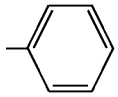 | H |
| D-14 | 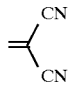 | 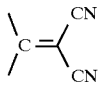 | 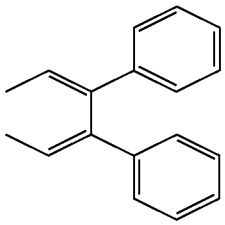 | | 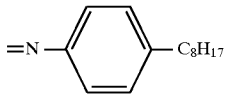 | |
| D-15 | 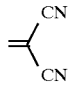 | 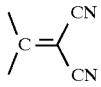 | 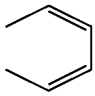 | | 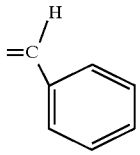 | |
| D-16 | =O | 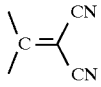 | 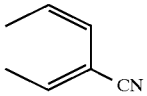 | | 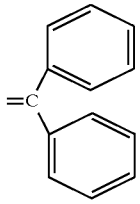 | |

The photoreceptor according to the invention is preferably comprised of a support having thereon the charge generation layer and further thereon the charge transport layer, as upper layer. However, the invention is not limited to such a constitution, and effects of the invention can be displayed in various forms.

Representative constitutions of the electrophotographic photoreceptor according to the invention are shown in FIGS. 1-*a* through 1-*f*. In FIG. 1-*a*, on a conductive support (1) is provided a charge generation layer (2) and further thereon a charge transport layer (3) to form a photoreceptor layer (4). In FIG. 1-*b*, the charge generation layer (2) and charge transport layer (3) are reversely arranged to form the photoreceptor layer (4). In FIG. 1-*c*, an interlayer (5) is provided between the conductive support (1) and the photoreceptor layer (4) which is arranged in the same manner as in FIG. 1-*a*. In FIG. 1-*d*, the interlayer (5) is provided between the conductive support (1) and the photoreceptor layer (4) which is arranged in the same manner as in FIG. 1-*b*. In FIG. 1-*e* is provided a photoreceptor layer (4') containing charge generating material and charge transporting material. In FIG. 1-*f*, an interlayer (5) is provided between the conductive support (1) and the photoreceptor layer (4'). In FIGS. 1-*a* to 1-*f*, a protective layer may be provided on the uppermost surface layer.

The photoreceptor layer can be formed by coating a previously prepared coating solution through dip coating, spray coating, bar coating, roll coating blade coating or applicator coating and drying, or by vacuum-deposition coating.

A coating solution of the charge generation layer can be prepared by dispersing a charge generating material singly, or with a binder or an adjuvant in an appropriate dispersing medium, in the form of fine particle dispersion, using an ultrasonic homogenizer, ball mill, sand mill or homomixer. A coating solution of the charge transport layer can generally be prepared by dissolving the charge transporting material with a binder in an appropriate solvent and optionally adding thereto an adjuvant. Examples of the solvent used in the coating solution include acetone, methyl ethyl ketone, cyclohexanone, tetrahydrofuran, dioxane, ethyl acetate, butyl acetate, methylcellosolve, ethylcellosolve, ethylene glycol methyl ether, toluene, xylene, acetophenone, chloroform, dichloromethane, cycloethane, trichloroethane, methanol, ethanol, propanol, and butanol.

Examples of the binder used for forming the charge generation layer and charge transport layer include polycarbonate, polycarbonate Z resin, acryl resin, methacryl resin, poly(vinyl chloride), poly(vinylidene chloride), polystyrene, styrene-butadiene copolymer, poly(vinyl acetate), poly(vinyl formal), poly(vinyl butylal), poly(vinyl acetal), poly(vinyl carbazole), styrene-alkyd resin, silicone resin, silicone-alkyd resin, polyester, phenol resin, polyurethane, epoxy resin, vinylidene chloride-vinyl acetate copolymer and vinyl chloride-vinyl acetate-anhydrous maleic acid copolymer. A ratio of a charge generating material to a binder is preferably 1/9 to 9/1 and more preferably 1/2 to 6/1. A ratio of an electron transporting material to a binder in the electron-transporting charge transport layer is preferably 1/5 to 2/1 and more preferably 1/4 to 1/1.

A thickness of the charge generation layer is 0.01 to 20 μm, and preferably 0.05 to 5 μm. A thickness of the charge transport layer is 1 to 100 μm and preferably 5 to 40 μm.

As a binder used for the interlayer and the protective layer are usable the same one as in used in the charge generation layer and the charge transport layer. Further thereto are usable polyamide resin, nylon resin, ethylenic resin such as ethylene-vinyl acetate copolymer, ethylene-vinylacetate-anhydrous maleic acid copolymer or ethylene-vinyl acetate-methacrylic acid copolymer, poly(vinyl alcohol) and cellulose derivatives. A heat-hardenable or chemically hardenable resin such as melamine, epoxy or isocyanate can also be used as a binder.

There can be incorporated into the photoreceptor layer a variety of adjuvants for the purpose of enhancing potential characteristics, storage stability, durability, environment dependence.

As the conductive support are employed metal plate and metal drum. There is also employed a support in which a conductive compound such as conductive polymer or indium oxide, or a thin layer of metals such as aluminum and paradium is provided on a substrate such as paper or plastic film by means of coating, vacuum deposition or lamination.

EXAMPLES

The present invention will be explained furthermore in detail based on examples, but embodiments of the invention are not limited these examples. In the following examples, the term, "part(s)" represents part(s) by weight.

Example 1

On an aluminum-deposited PET film was provided an interlayer comprised of polyamide resin (trade name, CM8000 produced by Toray) with a thickness of 0.2 μm. A solution which was prepared by dispersing 1 part of titanyl phthalocyanine having peaks at Bragg angles (2 θ) of 9.5°, 24.1° and 27.2° in its X ray diffractometry and 0.5 parts of silicone-butyral resin in 50 parts of methyl ethyl ketone as a dispersing medium by means of a sand mill, was further coated thereon using a wire-bar to forma charge generation layer with a thickness of 0.4 μm. Furthermore, a coating solution of a charge transport layer which was prepared by 100 parts of an electron-transporting material (A-7) and 130 parts of styrene-acryl copolymer (trade name, MS200, produced by Shi-Nittetsu Kagaku) in 700 parts of tetrahydrofuran and further adding thereto an amine compound (Z-7) in an amount as shown in Table 1, was coated on the charge generation layer by a doctor blade and dried to form a charge transport layer with a dry layer thickness of 17 μm. Electrophotographic photoreceptor samples 1a to 1e were prepared as shown in Table 1.

Evaluation-1

The prepared photoreceptors each were evaluated using an electrostatic copying test apparatus (EPA-8100, produced by Kawaguchi Electrics). Thus, samples were subjected to corona discharge of +6 kV, and after being allowed to stand for 5 sec. in the dark, a surface potential (Vi) was measured. Subsequently, samples were exposed to white light with an illuminance of 10 lux for a period of 10 sec. and after further exposed to light with 10 lux for 2 sec., a surface potential of each sample was measured as a residual potential (Vr). Results thereof are shown in Table 1.

TABLE 1

| Sample | Amine compd. | Eox (V) | Amount (parts) | Vi (V) | Vr (V) |
|---|---|---|---|---|---|
| 1a | Z-7 | 0.58 | 0 | 800 | 42 |
| 1b | Z-7 | 0.58 | 5 | 780 | 7 |
| 1c | Z-7 | 0.58 | 10 | 785 | 8 |
| 1d | Z-7 | 0.58 | 20 | 790 | 14 |
| 1e | Z-7 | 0.58 | 30 | 850 | 61 |

As can be seen from Table 1, the residual potential was effectively lowered within the range of addition of the amine compound according to the invention. When the amine compound was added in excess, sensitivity was reduced, presumably due to partial precipitation of the amine compound and the residual potential increased.

Example 2

On an aluminum-deposited PET film was provided an interlayer comprised of polyamide resin (trade name, CM8000 produced by Toray) with a thickness of 0.4 μm. A solution which was prepared by dispersing 1 part of titanyl phthalocyanine having peaks at Bragg angles (2 θ) of 9.5°, 24.1° and 27.2° in its X ray diffractometry and 0.5 parts of silicone-butyral resin in 50 parts of methyl isopropyl ketone as a dispersing medium by means of a sand mill, was further coated thereon using a wire-bar to forma charge generation layer with a thickness of 0.3 μm. Furthermore, a coating solution of a charge transport layer which was prepared by 100 parts of an electron-transporting material (C-4) and 170 parts of polycarbonate resin (Iupilon Z-200, produced by Mitsubishi Gas Chem. Co.) in 900 parts of tetrahydrofuran and further adding thereto an amine compound (Z-8) in an amount as shown in Table 2, was coated on the charge generation layer by a doctor blade and dried to form a charge transport layer with a dry layer thickness of 25 μm. Electrophotographic photoreceptor samples 1a to 2d were prepared as shown in Table 2.

TABLE 2

| Sample | Amine compd. | Eox (V) | Amount (parts) | Vi (V) | Vr (V) |
|---|---|---|---|---|---|
| 2a | Z-8 | 0.66 | 0 | 764 | 35 |
| 2b | Z-8 | 0.66 | 0.3 | 770 | 7 |
| 2c | Z-8 | 0.66 | 3 | 760 | 4 |
| 2d | Z-8 | 0.66 | 30 | 86 | 0 |

As can be seen from Table 1, the residual potential was effectively lowered within the range of addition of the amine compound according to the invention. When the amine compound was added in excess, charging was markedly lowered and characteristics for practical use could not obtained.

Example 3

Photoreceptor samples 3a through 31 were prepared in the same manner as in Example 1, except that the amine compound (Z-7) was replaced by 5 parts of an amine compound as shown in Table 3.

These samples ere evaluated in the same manner as in Example 1. Results thereof are summarized in Table 3.

TABLE 3

| Sam-ple | Amine compd. | Eox (V) | Amount (parts) | Vi (V) | Vr (V) |
|---|---|---|---|---|---|
| 3a | Z-1 | 0.57 | 5 | 775 | 8 |
| 3b | Z-2 | 0.57 | 5 | 781 | 8 |
| 3c | Z-3 | 0.57 | 5 | 777 | 7 |
| 3d | Z-4 | 0.56 | 5 | 768 | 9 |
| 3e | Z-5 | 0.58 | 5 | 790 | 10 |
| 3f | Z-6 | 0.58 | 5 | 796 | 11 |
| 3g | Z-9 | 0.58 | 5 | 780 | 8 |
| 3h | R-1 | 0.63 | 5 | 785 | 40 |
| 3i | R-2 | 0.49 | 5 | 794 | 44 |
| 3j | R-3 | 0.15 | 5 | 805 | 76 |
| 3k | R-4 | 0.96 | 5 | 788 | 45 |
| 3l | R-5 | 1.57 | 5 | 800 | 40 |

As can be seen from Table 3, reduction of the residual potential could not be achieved by the use of an aromatic amine compound or an aliphatic amine compound having an inappropriate oxidation potential.

Example 4

Photoreceptor samples 4a through 4j were prepared in the same manner as in Example 2, except that the amine compound (Z-8) was replaced by 5 parts of an amine compound as shown in Table 4.

These samples ere evaluated in the same manner as in Example 1. Results thereof are summarized in Table 4.

TABLE 4

| Sam-ple | Amine compd. | Eox (V) | Amount (parts) | Vi (V) | Vr (V) |
|---|---|---|---|---|---|
| 4a | Z-10 | 0.67 | 5 | 765 | 5 |
| 4b | Z-11 | 0.83 | 5 | 772 | 7 |
| 4c | Z-12 | 0.78 | 5 | 768 | 7 |
| 4d | Z-13 | 0.86 | 5 | 770 | 9 |
| 4e | Z-14 | 0.88 | 5 | 781 | 9 |
| 4f | Z-15 | 0.67 | 5 | 770 | 5 |
| 4g | R-6 | 1.62 | 5 | 772 | 37 |
| 4h | R-7 | 1.58 | 5 | 775 | 39 |
| 4i | R-8 | 0.98 | 5 | 760 | 34 |
| 4j | R-9 | 0.95 | 5 | 763 | 35 |

As can be seen from Table 4, reduction of the residual potential could be achieved according to the invention.

What is claimed is:

1. An electrophotographic photoreceptor comprising a conductive support and having thereon a photoreceptor layer comprising an electron-transporting charge transport layer containing an organic electron-transporting material in a binder, said electron transporting charge transport layer further containing an aliphatic amine compound having an oxidation potential of 0.5 to 0.9 V versus a silver/silver chloride electrode, in an amount of 0.01 to 20 parts by weight based on 100 parts of the electron-transporting material.

2. The electrophotographic photoreceptor of claim 1, wherein a charge generation material is contained in said charge transport layer or another layer.

3. The electrophotographic photoreceptor of claim 2, wherein said photoreceptor layer comprises a charge generation layer containing said charge generation material and said charge transport layer containing said electron-transporting material.

4. The electrophotographic photoreceptor of claim 1, wherein said aliphatic amine compound is represented by the following formula (1):

Formula (1)

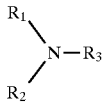

wherein $R_1$, $R_2$ and $R_3$ each represent a hydrogen atom, an alkyl group, or an alkenyl group, and $R_1$ and $R_2$ may combine with each other to form a ring, provided that $R_1$, $R_2$ and $R_3$ are not simultaneously hydrogen atoms.

5. The electrophotographic photoreceptor of claim 1, wherein said electron-transporting material is represented by the following formula (A), (B), (C), or (D):

Formula (A)

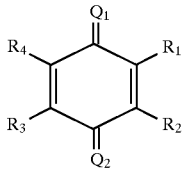

Formula (B)

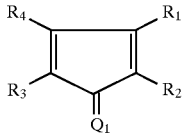

Formula (C)

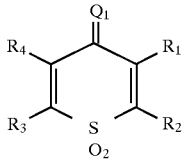

Formula (D)

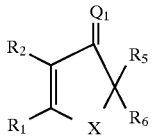

wherein X represents $>SO_2$ or $>C{=}Q_2$; $Q_1$ and $Q_2$ each represent $=O$, $=S$, $=N-R_7$, or $=C(Z_1)(Z_2)$; $R_1$ through $R_7$ each represent a hydrogen atom, a halogen atom, cyano group, a substituted vinyl group, an alkyl group, an aryl group, or a heterocyclic group, provided that $R_1$ and $R_2$, or $R_3$ and $R_4$ may combine with each other to form an aliphatic or aromatic ring; $R_5$ and $R_6$ may combine with each other to form $=N-R_7$; and $Z_1$ and $Z_2$ each represent an electron-withdrawing group.

6. The electrophotographic photoreceptor of claim 5, wherein said aliphatic amine compound is represented by the following formula (1):

Formula (1)

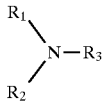

wherein $R_1$, $R_2$ and $R_3$ each represent a hydrogen atom, an alkyl group, or an alkenyl group, and $R_1$ and $R_2$ may combine with each other to form a ring, provided that $R_1$, $R_2$ and $R_3$ are not simultaneously hydrogen atoms.

* * * * *